US010160089B2

(12) United States Patent
Nakamura

(10) Patent No.: US 10,160,089 B2
(45) Date of Patent: Dec. 25, 2018

(54) POLISHING APPARATUS

(71) Applicant: EBARA CORPORATION, Tokyo (JP)

(72) Inventor: Akira Nakamura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 15/283,212

(22) Filed: Sep. 30, 2016

(65) Prior Publication Data

US 2017/0095901 A1 Apr. 6, 2017

(30) Foreign Application Priority Data

Oct. 1, 2015 (JP) ..... 2015-195823
Aug. 10, 2016 (JP) ..... 2016-157717

(51) Int. Cl.

| | |
|---|---|
| ***B24B 37/013*** | (2012.01) |
| ***B24B 49/04*** | (2006.01) |
| ***B24B 37/20*** | (2012.01) |
| ***B24B 49/10*** | (2006.01) |
| ***B24B 37/22*** | (2012.01) |
| ***B24B 37/26*** | (2012.01) |

(52) U.S. Cl.

CPC ..... *B24B 37/013* (2013.01); *B24B 37/205* (2013.01); *B24B 37/22* (2013.01); *B24B 37/26* (2013.01); *B24B 49/04* (2013.01); *B24B 49/105* (2013.01)

(58) Field of Classification Search

CPC ..... B24B 37/013; B24B 37/205; B24B 37/22; B24B 37/26; B24B 49/105; B24B 49/04
USPC ..... 451/5, 6, 11, 41, 285
See application file for complete search history.

(56) References Cited

U.S. PATENT DOCUMENTS

| | | | | |
|---|---|---|---|---|
| 6,206,754 | B1 * | 3/2001 | Moore | B24B 21/004 451/296 |
| 6,485,354 | B1 * | 11/2002 | Wolf | B24B 37/013 451/41 |
| 6,641,470 | B1 * | 11/2003 | Zhao | B24B 37/205 451/10 |
| 6,806,100 | B1 * | 10/2004 | Xu | B24B 37/205 438/8 |
| 6,875,078 | B2 * | 4/2005 | Birang | B24B 37/013 451/288 |
| 7,112,960 | B2 * | 9/2006 | Miller | B24B 37/013 324/228 |

(Continued)

FOREIGN PATENT DOCUMENTS

JP 2012-135865 A 7/2012

*Primary Examiner* — Eileen Morgan
(74) *Attorney, Agent, or Firm* — Baker & Hostetler LLP

(57) ABSTRACT

The polishing apparatus has: a polishing pad that has a polishing surface to polish a semiconductor wafer; a polishing table to which a back surface of the polishing pad on an opposite side of the polishing surface can be attached; a top ring that is opposed to the polishing surface, and can hold the semiconductor wafer; and an eddy current sensor that is arranged in the polishing table, and detects an end point of polishing. The polishing table has on an attachment surface a projection member projecting from the attachment surface to which the polishing pad is attached. The back surface of the polishing pad has a concave portion in a portion opposed to the projection member, and at least a part of the eddy current sensor is arranged inside the projection member.

14 Claims, 12 Drawing Sheets

(56) References Cited

U.S. PATENT DOCUMENTS

| | | | | |
|---|---|---|---|---|
| 8,439,994 | B2 * | 5/2013 | Allison | B24B 37/205 451/537 |
| 2001/0024880 | A1 * | 9/2001 | Hofmann | B24B 21/04 438/692 |
| 2002/0090889 | A1 * | 7/2002 | Crevasse | B24B 37/013 451/8 |
| 2005/0173259 | A1 * | 8/2005 | Mavliev | B23H 5/08 205/645 |
| 2008/0020690 | A1 * | 1/2008 | Birang | B24B 37/013 451/548 |
| 2008/0242195 | A1 * | 10/2008 | Heinrich | B24B 37/013 451/6 |
| 2009/0305610 | A1 * | 12/2009 | Yilmaz | B24B 37/013 451/6 |
| 2010/0297917 | A1 * | 11/2010 | Birang | B24B 37/013 451/5 |
| 2013/0065493 | A1 * | 3/2013 | Takahashi | B24B 37/013 451/59 |
| 2013/0337586 | A1 * | 12/2013 | Iizumi | H01L 22/10 438/16 |

* cited by examiner

POLISHING APPARATUS

CROSS-REFERENCE TO RELATED APPLICATION

This application claims priority to Japanese Patent Applications No. 195823-2015 filed on Oct. 1, 2015 and 157717-2016 filed on Aug. 10, 2016. The entire disclosure of Japanese Patent Applications No. 195823-2015 filed on Oct. 1, 2015 and 157717-2016 filed on Aug. 10, 2016 are incorporated herein by reference in its entirety.

TECHNICAL FIELD

The present invention relates to polishing apparatuses and, in particular, to a polishing apparatus including an end point detection sensor that detects an end point of polishing, and is used to polish a conductive film formed on a substrate, such as a semiconductor wafer.

BACKGROUND ART

In recent years, as a semiconductor device is highly integrated, wiring of a circuit is miniaturized, and an inter-wiring distance is also becoming narrower. Consequently, it becomes necessary to planarize a surface of a semiconductor wafer that is a polishing target, and polishing by a polishing apparatus is performed as one means of a planarization method.

The polishing apparatus includes: a polishing table for holding a polishing pad for polishing the polishing target; and a top ring for holding the polishing target and pressing it against the polishing pad. The polishing table and the top ring are rotationally driven by a drive unit (for example, a motor), respectively. Liquid (slurry) containing a polishing agent is poured on the polishing pad, the polishing target held by the top ring is pressed against it, and thereby the polishing target is polished.

In the polishing apparatus, when polishing of the polishing target is insufficient, insulation between circuits cannot be taken, and short circuit might occur. In addition, in a case where excessive polishing is performed, there arises a problem, such as rise of a resistance value due to decrease in a cross-sectional area of a wiring, or the circuit itself not being formed due to complete removal of the wiring itself. Therefore, it is required to detect the most suitable polishing end point in the polishing apparatus.

As such a technology, there is an eddy current type end point detection sensor (hereinafter, referred to as an "eddy current sensor") described in Japanese Patent Laid-Open No. 2012-135865. In the eddy current sensor, a solenoid-type or a spiral-type coil is used.

In recent years, in order to reduce a rate of defective products near an edge of a semiconductor wafer, there is a request of measuring a film thickness nearer the edge of the semiconductor wafer, and performing film-thickness control by in-situ closed loop control.

In addition, in top rings, there is included a top ring of an airbag head system utilizing a pneumatic pressure etc. An airbag head has a plurality of concentric airbags. In order to improve a resolution of unevenness of a surface of the semiconductor wafer by the eddy current sensor, and to perform film-thickness control in the airbags with a narrow width, there is a request of measuring a film thickness in a narrower range.

However, in the solenoid-type or the spiral-type coil, a magnetic flux is hard to be made thin, and there is a limit in measuring the film thickness in the narrow range.

An area of an eddy current (i.e. a spot diameter of the eddy current sensor) formed on a polishing surface of the semiconductor wafer by a conventional common eddy current sensor is not less than approximately 20 mm, a detection monitor region per spot is generally wide, and only an averaged film thickness of a wide range of region is obtained. Therefore, there is a limit in detection accuracy of presence/absence of a residual film and in accuracy of profile control, and particularly, variation in film thickness in an edge portion of a polished substrate cannot be dealt with. This is because in a conductive film, such as a copper film formed on the substrate being polished, the edge portion of the substrate serves as a boundary region, and a film thickness of a film formed at the edge portion is more easily changed compared with a film thickness of a film formed at the other position. In addition, it is generally difficult to detect a residual film with a width not more than 6 mm that remains in a part of the substrate, and the film to be normally polished may remain in a part of the substrate in some cases depending on fluctuations in a formation state of the film onto the substrate, or fluctuations in polishing conditions of the film, etc.

Note that one of reasons why the spot diameter of the eddy current sensor is wide is that a sensor coil diameter is large. In order to solve the above, it can be considered that the sensor coil diameter of the eddy current sensor is reduced, and that the detection monitor region of the film thickness is reduced. However, a distance from the eddy current sensor to the film in which the film thickness can be detected by the eddy current sensor has a correlation with the sensor coil diameter, and the distance becomes smaller as the sensor coil diameter is reduced. Since a polishing pad is present between the eddy current sensor and the substrate, a distance between the eddy current sensor and the substrate cannot be set to be not less than a thickness of the polishing pad. When the sensor coil diameter is reduced, the distance from the eddy current sensor to the film in which the film thickness can be detected by the eddy current sensor becomes smaller, it becomes difficult to form an eddy current on the substrate due to the thickness of the polishing pad, and thus detection of the film thickness becomes difficult.

Another reason why the spot diameter of the eddy current sensor is wide is that the magnetic flux widens since a distance between the semiconductor wafer and the eddy current sensor is large. When the same coil is used, the larger the distance between the semiconductor wafer and the eddy current sensor becomes, the wider the magnetic flux spreads, and the larger the spot diameter of the eddy current sensor becomes. The wider the magnetic flux spreads, the weaker the magnetic flux becomes, the weaker an eddy current formed on the semiconductor wafer becomes, and as a result, a sensor output becomes small. In order to accurately control a film thickness of the semiconductor wafer, an eddy current sensor that can measure a narrow range is desired.

The present invention has been made in view of the above-described circumstances, and an object thereof is to provide a polishing apparatus that has an end point detection sensor capable of measuring a narrow range, and in which film thickness detection accuracy has been improved.

SUMMARY OF INVENTION

According to a first mode of a polishing apparatus of the invention in the present application, there is provided a polishing apparatus including: a polishing table to which a back surface of a polishing pad is attached, wherein the polishing pad has a polishing surface for polishing a polishing target, and the back surface is on an opposite side of the polishing surface; a holding part that is opposed to the polishing surface of the polishing pad, and can hold the polishing target; and an end point detection sensor that is arranged in the polishing table, and detects an end point of the polishing, in which the polishing table has on an attachment surface a projection member projecting from the attachment surface to which the polishing pad is attached, and in which at least a part of the end point detection sensor is arranged inside the projection member.

BRIEF DESCRIPTION OF DRAWINGS

FIG. 3A is a block diagram showing the configuration of the eddy current sensor, and FIG. 3B is an equivalent circuit diagram of the eddy current sensor;

DESCRIPTION OF EMBODIMENTS

Hereinafter, an embodiment of a polishing apparatus according to one example of the present invention will be explained in detail with reference to accompanying drawings. Note that in the accompanying drawings, the same symbol is given to the same or a corresponding component, and overlapping explanation thereof is omitted.

Figure 1:
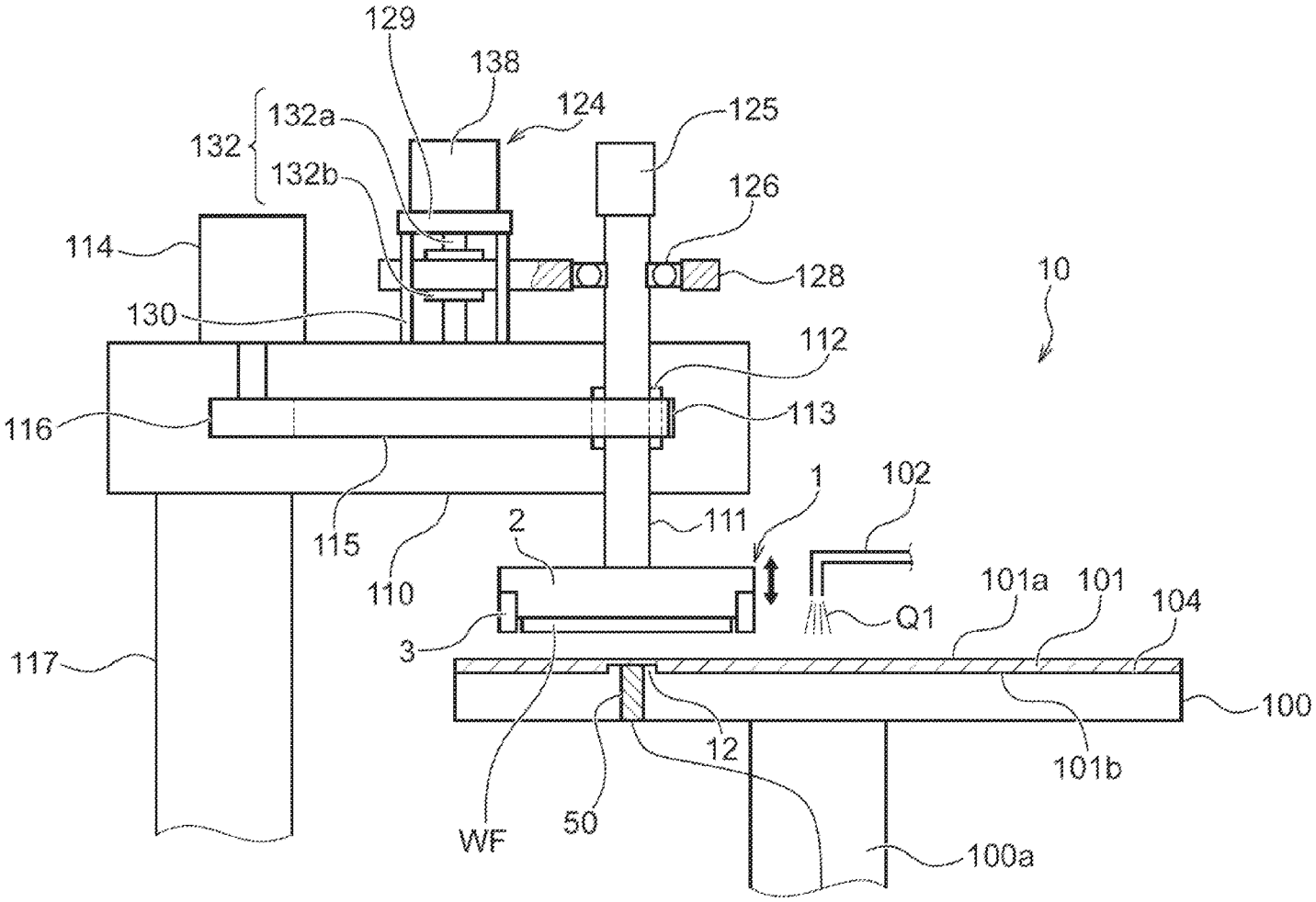
FIG. 1 is a schematic diagram showing an overall configuration of a polishing apparatus according to the example.

FIG. 1 is a schematic diagram showing an overall configuration of a polishing apparatus 10 according to one example of the present embodiment. As shown in FIG. 1, the polishing apparatus 10 includes: a polishing table 100; and a top ring (a holding part) 1 that holds a substrate, such as a semiconductor wafer WF, which is a polishing target, and presses it against a polishing surface on the polishing table 100.

The polishing table 100 is coupled to a motor (not shown) that is a drive unit arranged under the polishing table 100 through a table shaft 100*a*, and can be rotated around the table shaft 100*a*. A polishing pad 101 is stuck on an upper surface (an attachment surface) 104 of the polishing table 100. A surface 101*a* of the polishing pad 101 is included in a polishing surface that polishes the semiconductor wafer WF. A back surface 101*b* of the polishing pad 101 on an opposite side of the polishing surface 101*a* is attached to the attachment surface 104 of the polishing table 100. The top ring 1 can be opposed to the polishing surface 101*a* of the polishing pad 101 to thereby hold the semiconductor wafer WF.

A polishing liquid supplying nozzle 102 is installed above the polishing table 100. A polishing liquid Q1 is supplied on the polishing pad 101 on the polishing table 100 by the polishing liquid supplying nozzle 102. As shown in FIG. 1, an eddy current sensor (an end point detection sensor) 50 that detects an end point of polishing is embedded inside the polishing table 100.

Top ring 1 basically includes: a top ring body 2 that presses the semiconductor wafer WF against the polishing surface 101*a*; and a retainer ring 3 that holds an outer peripheral edge of the semiconductor wafer WF, and keeps the semiconductor wafer WF from protruding from the top ring.

The top ring 1 is connected to a top ring shaft 111. The top ring shaft 111 vertically moves to a top ring head 110 by a vertical movement mechanism 124. The whole top ring 1 is elevated and positioned to the top ring head 110 by the vertical movement of the top ring shaft 111. Note that a rotary joint 125 is attached to an upper end of the top ring shaft 111.

The vertical movement mechanism 124 that vertically moves the top ring shaft 111 and the top ring 1 includes: a bridge 128 that rotatably supports the top ring shaft 111 through a bearing 126; a ball screw 132 attached to the bridge 128; a support base 129 supported by support posts 130; and an AC servomotor 138 provided on the support base 129. The support base 129 that supports the servomotor 138 is fixed to the top ring head 110 through the support posts 130.

The ball screw 132 includes: a screw shaft 132*a* coupled to the servomotor 138; and a nut 132*b* with which the screw shaft 132*a* is screwed. The top ring shaft 111 vertically moves integrally with the bridge 128. Accordingly, when the servomotor 138 is driven, the bridge 128 vertically moves through the ball screw 132, and hereby the top ring shaft 111 and the top ring 1 vertically move.

In addition, the top ring shaft 111 is coupled to a rotary cylinder 112 through a key (not shown). The rotary cylinder 112 includes a timing pulley 113 at an outer peripheral portion thereof. A top ring motor 114 is fixed to the top ring head 110, and the above-described timing pulley 113 is connected to a timing pulley 116 provided at the top ring motor 114 through a timing belt 115. Accordingly, the rotary cylinder 112 and the top ring shaft 111 integrally rotate through the timing pulley 116, the timing belt 115, and the timing pulley 113 by rotationally driving the top ring motor 114, and thereby the top ring 1 rotates. Note that the top ring head 110 is supported by a top ring head shaft 117 rotatably supported by a frame (not shown).

In the polishing apparatus configured as shown in FIG. 1, the top ring 1 can hold a substrate, such as the semiconductor wafer WF, on a lower surface thereof. The top ring head 110 is configured so as to be able to turn around the top ring shaft 117, and the top ring 1 holding the semiconductor wafer WF on the lower surface thereof is moved from a receiving position of the semiconductor wafer WF to an upper side of the polishing table 100 by the turn of the top ring head 110. The top ring 1 is then lowered, and the semiconductor wafer WF is pressed against the surface (the polishing surface) 101*a* of the polishing pad 101. At this time, the top ring 1 and the polishing table 100 are rotated, respectively, and a polishing liquid is supplied on the polishing pad 101 from the polishing liquid supplying nozzle 102 provided above the polishing table 100. As described above, the semiconductor wafer WF is slid onto the polishing surface 101*a* of the polishing pad 101, and a surface of the semiconductor wafer WF is polished.

Figure 2:
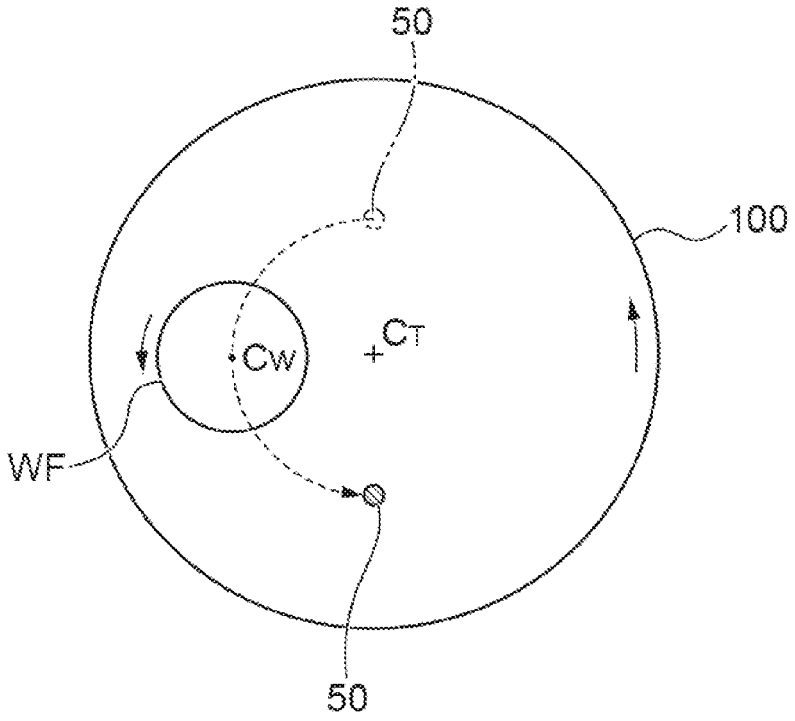
FIG. 2 is a plan view showing a relation among a polishing table, an eddy current sensor, and a semiconductor wafer.

FIG. 2 is a plan view showing a relation among the polishing table 100, the eddy current sensor 50, and the semiconductor wafer WF. As shown in FIG. 2, the eddy current sensor 50 is installed at such a position that it passes through a center Cw of the semiconductor wafer WF during polishing held by the top ring 1. A symbol $C_T$ is a rotation center of the polishing table 100. For example, the eddy current sensor 50 can continuously detect a metal film (a conductive film), such as a Cu layer of the semiconductor wafer WF, on a passing trace (a scanning line), while passing through a lower side of the semiconductor wafer WF.

Next, the eddy current sensor 50 included in the polishing apparatus according to one example of the present invention will be explained in more detail using the accompanying drawings.

Figure 3A:
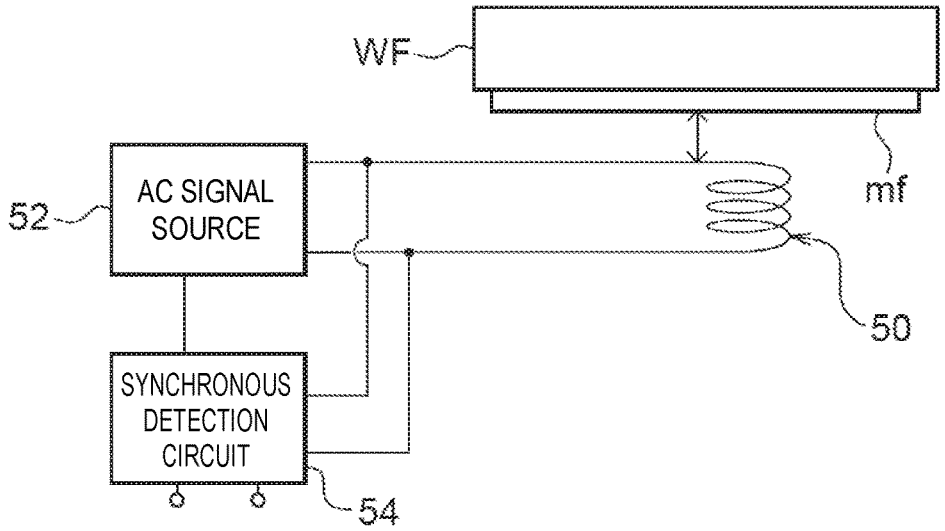
FIGS. 3A and 3B are diagrams showing a configuration of the eddy current sensor.
Figure 3B:
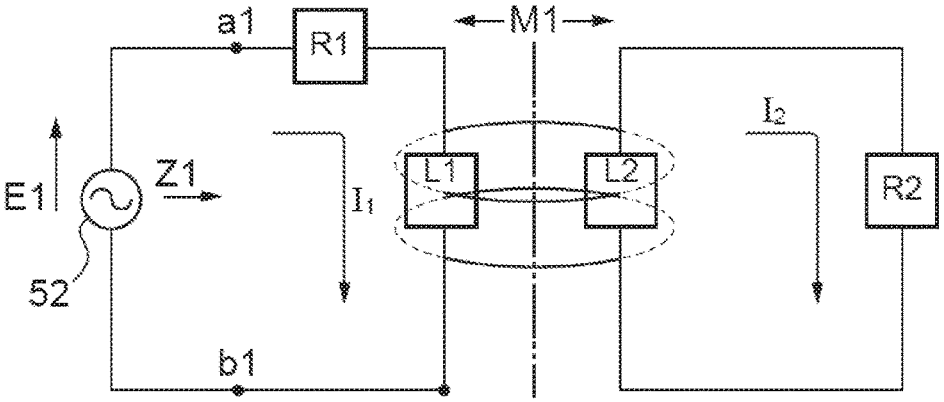

FIGS. 3A and 3B are diagrams showing a configuration of the eddy current sensor 50, FIG. 3A is a block diagram showing the configuration of the eddy current sensor 50, and FIG. 3B is an equivalent circuit diagram of the eddy current sensor 50.

As shown in FIG. 3A, the eddy current sensor 50 is arranged near a metal film (or a conductive film) mf as a detection target. Specific arrangement of the eddy current sensor 50 will be mentioned later. An AC signal source 52 is connected to a coil of the eddy current sensor 50. Here, the metal film (or the conductive film) mf as the detection target is, for example, a thin film of Cu, Al, Au, W, or the like formed on the semiconductor wafer WF. The eddy current sensor 50 is arranged in a vicinity of approximately 1.0 to 4.0 mm from the metal film (or the conductive film) as the detection target.

Eddy current sensors include: a frequency type in which an oscillation frequency is changed due to generation of an eddy current at the metal film (or the conductive film) mf, and in which change in film thickness of the metal film (or the conductive film) is detected from the frequency change; and an impedance type in which an impedance is changed, and in which change in film thickness of the metal film (or the conductive film) is detected from the impedance change. Namely, in the frequency type, in an equivalent circuit shown in FIG. 3B, when an eddy current $I_2$ is changed, thereby an impedance Z1 is changed, and an oscillation frequency of the signal source (a variable frequency oscillator) 52 is changed, the change in oscillation frequency is detected in a detector circuit 54, and change in the metal film (or the conductive film) can be detected. In the impedance type, in the equivalent circuit shown in FIG. 3B, when the eddy current $I_2$ is changed, thereby the impedance Z1 is changed, and the impedance Z1 seen from the signal source (a fixed frequency oscillator) 52 is changed, the change in the impedance Z1 is detected in the detector circuit 54, and change in the metal film (or the conductive film) can be detected.

In an impedance-type eddy current sensor, a resistance component (R1), a reactance component (X1), an amplitude output ($(R1^2+X1^2)^{1/2}$), and a phase output ($\tan^{-1}R1/X1$) associated with the change in film thickness can be extracted. Measurement information on the change in film thickness of the metal film (or the conductive film) Cu, Al, Au, or W is obtained from a frequency or the amplitude output ($(R1^2+X1^2)^{1/2}$), etc. The eddy current sensor 50 can be incorporated in a position near a surface inside the polishing table 100 as shown in FIG. 1, is located so as to face the semiconductor wafer of a polishing target through the polishing pad, and can detect change in the metal film (or the conductive film) from an eddy current that flows through the metal film (or the conductive film) on the semiconductor wafer.

As a frequency of the eddy current sensor, a single radio wave, mixed radio waves, an AM modulation radio wave, an FM modulation radio wave, a sweep output of a function generator, or a plurality of oscillation frequency sources can be used. It is preferable to select a highly sensitive oscillation frequency and modulation scheme in conformity to a film type of the metal film.

Hereinafter, the impedance-type eddy current sensor will be specifically explained. The AC signal source 52 is an oscillator with a fixed frequency of approximately 2 to 30 MHz and, for example, a crystal oscillator is used therefor. Additionally, a current $I_1$ flows through the eddy current sensor 50 by an AC voltage supplied by the AC signal source 52. The current flows through the eddy current sensor 50 arranged near the metal film (or the conductive film) mf, and thereby a magnetic flux caused by the current is interlinked with the metal film (or the conductive film) mf, whereby a mutual inductance M1 is formed therebetween, and an eddy current $I_2$ flows through the metal film (or the conductive film) mf. Here, R1 is a primary-side equivalent resistance including the eddy current sensor, and similarly, $L_1$ is a primary-side self-inductance including the eddy current sensor. In a metal film (or a conductive film) mf side, R2 is an equivalent resistance corresponding to an eddy current loss, and $L_2$ is a self-inductance thereof. The impedance Z1 in a case of seeing an eddy current sensor side from terminals a1 and b1 of the AC signal source 52 is changed with magnitude of the eddy current loss formed in the metal film (or the conductive film) mf.

Figure 4A:
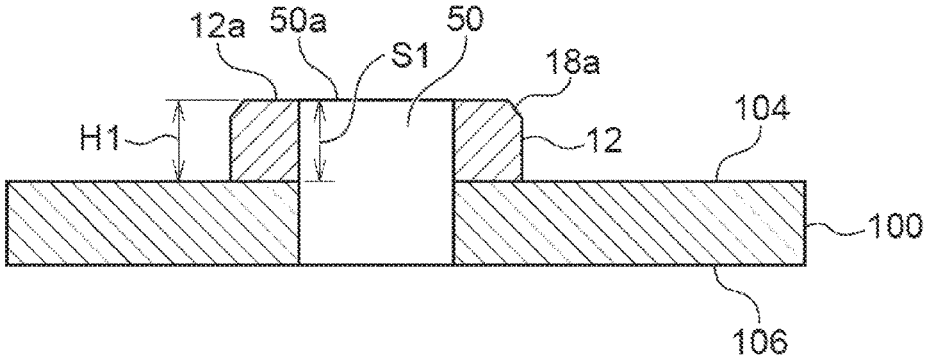
FIGS. 4A to 4C show enlarged views of a vicinity of an eddy current sensor 50 of FIG. 1.
Figure 4B:
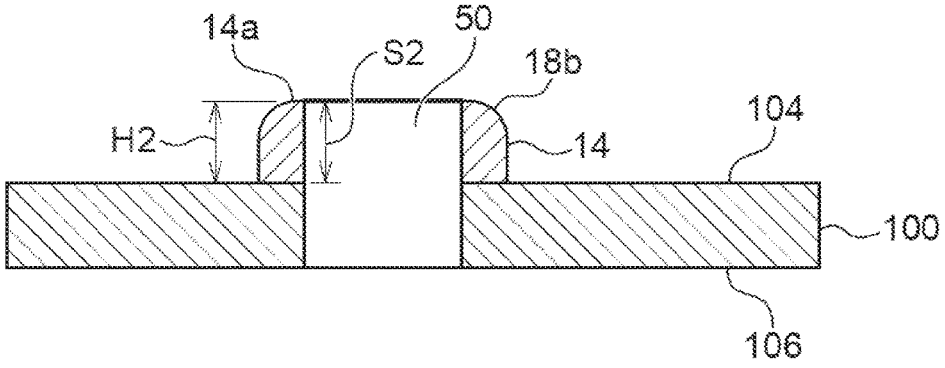
Figure 4C:
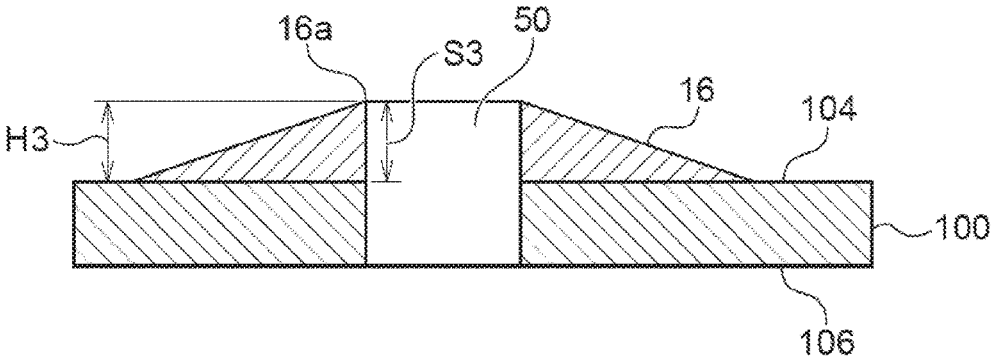

In FIGS. 4A to 4C, there are shown enlarged cross-sectional views of a vicinity of the eddy current sensor 50 of FIG. 1. The polishing table 100 has on the planar attachment surface 104 projection members 12, 14, and 16 projecting from the attachment surface 104 to which the polishing pad 101 is attached. Various shapes can be considered as shapes of projecting portions. FIGS. 4A to 4C each show one example of various shapes of the projection members 12, 14, and 16, FIGS. 4A and 4B show the cylindrical projection members 12 and 14, and FIG. 4C shows the truncated cone-shaped projection member 16. A difference between the shapes of the projection member 12 of FIG. 4A and the projection member 14 of FIG. 4B lies in a corner 18 of the projection members. A corner 18a of the projection member 12 of FIG. 4A is not round, and a corner 18b of the projection member 14 of FIG. 4B is round.

The back surface 101*b* of the polishing pad 101 has a concave portion in each of portions opposed to the projection members 12, 14, and 16. Details of the concave portion will be mentioned later. At least a part of the eddy current sensor 50 is arranged inside the projection members 12, 14, and 16. The other portion of the eddy current sensor 50 is arranged inside the polishing table 100 below the attachment surface 104. Accordingly, the whole eddy current sensor 50 is arranged inside the polishing table 100. The eddy current sensor 50 is fixed to the projection members 12, 14, and 16 or the polishing table 100 by means, such as adhesion or screwing.

Although the eddy current sensor 50 projects toward the inside of the polishing table 100 from the projection members 12, 14, and 16, it does not project toward an outside of the polishing table 100 from the projection members 12, 14, and 16. When the eddy current sensor 50 projects toward the outside of the polishing table 100 from the projection members 12, 14, and 16, the eddy current sensor 50 may interfere with the polishing pad 101 located around the projection members 12, 14, and 16.

Heights S1, S2, and S3 of an upper surface 50*a* of the eddy current sensor 50 from the attachment surface 104 are, as shown in FIGS. 4A to 4C, preferably the same as heights H1, H2, and H3 of uppermost portions 12*a*, 14*a*, and 16*a* of the projection members 12, 14, and 16 from the attachment surface 104, respectively. By being the same, a distance between the eddy current sensor 50 and the wafer WF can be minimized, while the eddy current sensor 50 is prevented from interfering with the polishing pad 101.

As shown in FIGS. 4A to 4C, in the example, the part of the eddy current sensor 50 is not made to project in a direction of the polishing pad 101 from the polishing table 100, but a shape of the polishing table 100 is changed, i.e. the projection members 12, 14, and 16 are provided as the part of the polishing tables 100, and the eddy current sensor 50 is absolutely limited to the inside of the polishing table 100 (a "platen"). The following is included as advantages of a system of FIGS. 4A to 4C.

Since the eddy current sensor does not come into contact with the polishing pad, it is mechanically (physically) protected from the polishing pad. Note that in FIGS. 6A, 6B, 8A, and 8B, which will be mentioned later, in a case where the heights S1, S2, and S3 are the same as the heights H1, H2, and H3, respectively, the eddy current sensor may come into contact with the polishing pad, and thus the heights S1, S2, and S3 are set to be slightly lower than the heights H1, H2, and H3, respectively.

In a case where the end point detection sensor is exposed outside toward the polishing pad from the attachment surface of the polishing table without using the projection member of the example, in a case where the polishing pad is exchanged for a polishing pad with a different shape, or is exchanged for a new polishing pad with the same shape, the previously mentioned problem occurs. In the example, before and after the polishing pad with the different shape is newly attached, or before and after the polishing pad is exchanged for the new one, the height of the eddy current sensor from the attachment surface 104, i.e. the polishing table 100, is always the same position (the same height), and position adjustment (height adjustment) is unnecessary. Accordingly, it becomes possible to set a distance between the polishing target and the eddy current sensor to be always the same at the time of polishing start before and after the polishing pad is exchanged.

Since the projection member exerts a force on the polishing target through the polishing pad, the shape of the projection member may affect a polished state. In that case, the effect on the polishing can be reduced by changing only the shape of the projection member without changing electrical characteristics and the shape of the eddy current sensor.

Note that although it is not preferable to make the eddy current sensor 50 project outside in the direction of the polishing pad 101 (i.e. upwardly) from the projection members 12, 14, and 16, it may be made to project toward outside, i.e. downwardly from a lower surface 106 of the polishing table 100.

Figure 5:
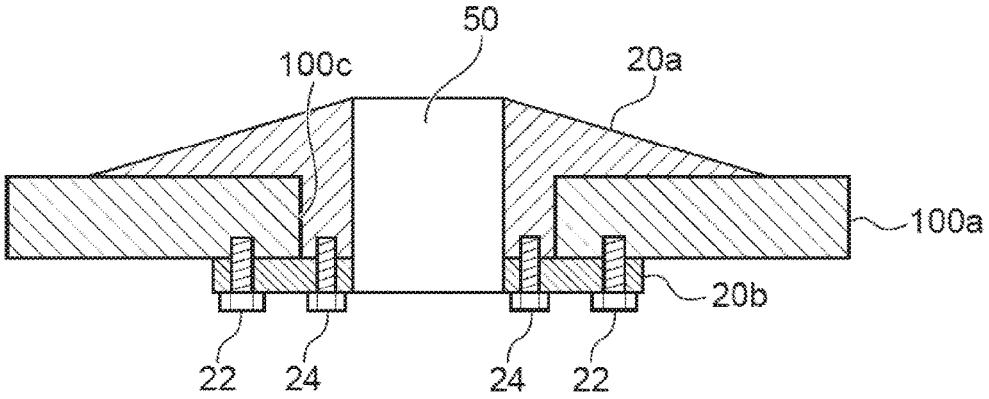
FIG. 5 is a cross-sectional view showing a projection member that is a component part independent from the polishing table.

Although the projection members 12, 14, and 16 of FIGS. 4A to 4C are integrated with the polishing table 100, the projection member need not be integrated with the polishing table 100. In FIG. 5, there is shown a projection member 20 of an attachment system that is a component part independent from the polishing table. The projection member 20 has an upper part 20*a* and a lower part 20*b*, and the upper part 20*a* is inserted into a hole 100*c* provided in the polishing table 100*a*. The projection member 20 is attached to the polishing table 100*a* as follows. First, the lower part 20*b* is attached to the polishing table 100*a* by a plurality of screws 22. Next, the upper part 20*a* is attached to the lower part 20*b* by a plurality of screws 24.

The eddy current sensor 50 is previously assembled with the upper part 20*a* and subsequently, an assembly is attached to the polishing table 100*a*, or the projection member 20 is attached to the polishing table 100*a* and subsequently, the eddy current sensor 50 is attached to the upper part 20*a*. Although the screws 22 and 24 are used in FIG. 5, a fastening method is not limited to the screw. The fastening method may be adhesion, welding, etc.

Next, a concave portion 30 provided in the back surface 101*b* of the polishing pad 101 will be explained by FIGS. 6A and 6B to 9A and 9B. The concave portion 30 is provided in a portion opposed to each of the projection members 12, 14, and 16. The polishing pad 101 has: a polishing layer 26 having the polishing surface 101*a*; and a backing layer 28 having the back surface 101*b*. The polishing layer 26 includes a foamed polyurethane sheet etc. The backing layer 28 includes polyurethane or a non-woven fabric, etc. The polishing layer 26 has foamed structure or non-foamed structure. In a case of the non-foamed structure, the polishing surface 101*a* is damaged by dressing treatment to polyurethane etc., whereby treatment to enhance retention ability of a polishing agent is made.

Figure 6A:
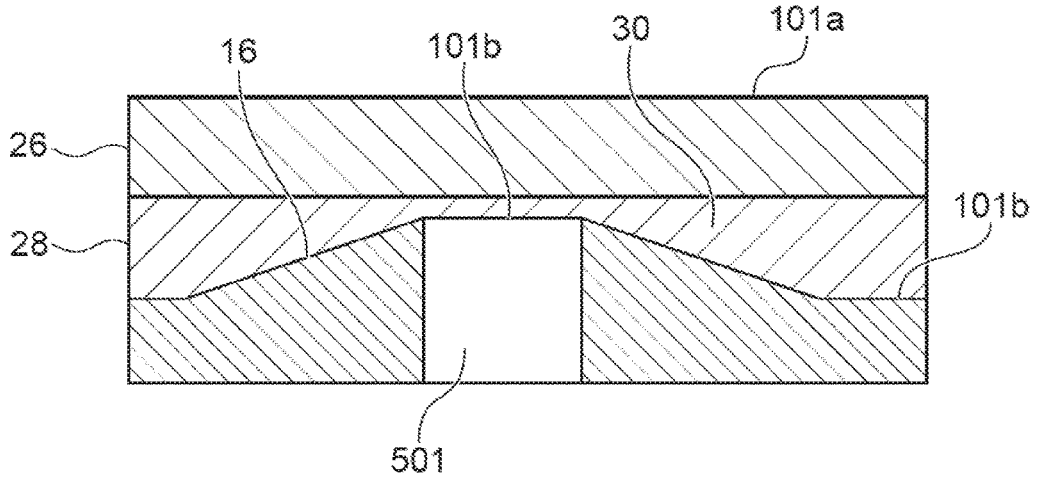
FIGS. 6A and 6B are views showing a concave portion 30 provided in a back surface 101*b* of a polishing pad 101.
Figure 6B:
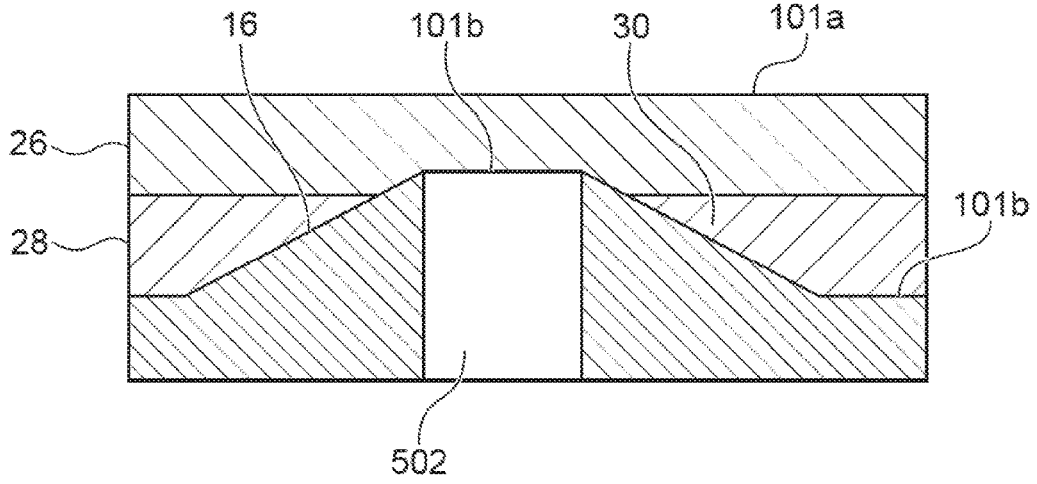

In FIGS. 6A and 6B to 9A and 9B, there are shown how the concave portion 30 is formed in cases of a tall eddy current sensor 501 and a short eddy current sensor 502, respectively. FIGS. 6A, 7A, 8A, and 9A show the concave portion 30 in the case of the short eddy current sensor 501. FIGS. 6B, 7B, 8B, and 9B show the concave portion 30 in the case of the tall eddy current sensor 502. In the case of the tall eddy current sensor 501, a part of the eddy current sensor 50 is set to be caved in the polishing layer 26 as shown in FIG. 6B, and in the case of the short eddy current sensor 502, the eddy current sensor 50 is set not to be caved in the polishing layer 26.

FIGS. 6A and 6B to 9A and 9B may be considered to show how the concave portion 30 is formed in a case where the distance between the polishing target and the eddy current sensor 50 is far (FIGS. 6A, 7A, 8A, and 9A), and in a case where the distance is near (FIGS. 6B, 7B, 8B, and 9B), respectively.

As methods for forming the concave portion 30, there is included a method in which a thickness of at least one of the polishing layers 26 and the backing layer 28 in the concave portion 30 is made thinner than that of at least one of the polishing layers 26 and the backing layer 28 other than the concave portion 30. In this case, in the concave portion 30, at least one of the polishing layer 26 and the backing layer 28 has a hollow on a polishing surface side. Hereinafter, the above will be specifically explained.

In FIG. 6A, a hollow is provided only in the backing layer 28 (only a part of the backing layer 28 is made thin without changing the thickness of the polishing layer 26), and the concave portion 30 is formed. In FIG. 6B, a part of the polishing layer 26 is made thin, and a part of the backing layer 28 is completely removed, whereby a hollow is provided in the polishing layer 26 and the backing layer 28, and the concave portion 30 is formed.

Although in the concave portion 30, the parts of the polishing layer 26 and the backing layer 28 are made thin by being partially removed, and the hollows can be formed, a method for making thin the polishing layer 26 and the backing layer 28 without removing any of them can be employed as a method for forming the hollow. For example, there is a method for deforming the existing polishing layer 26 and backing layer 28 (foamed polyurethane and non-foamed polyurethane) with heat, and thereby forming hollows without removing the parts of the existing (i.e. already completed) polishing layer 26 and backing layer 28 at all. In a case of heat deformation, there is an advantage that the hollows can be easily formed in the arbitrary polishing layer 26 and backing layer 28. In a specification in the present application, in a case of describing that the polishing layer 26 and the backing layer 28 are made thin, which means both removing and making thin the polishing layer 26 and the backing layer 28, and making them thin by heat deformation without removing them. Note that they may be made thin using both heat deformation treatment and removal treatment.

Figure 7A:
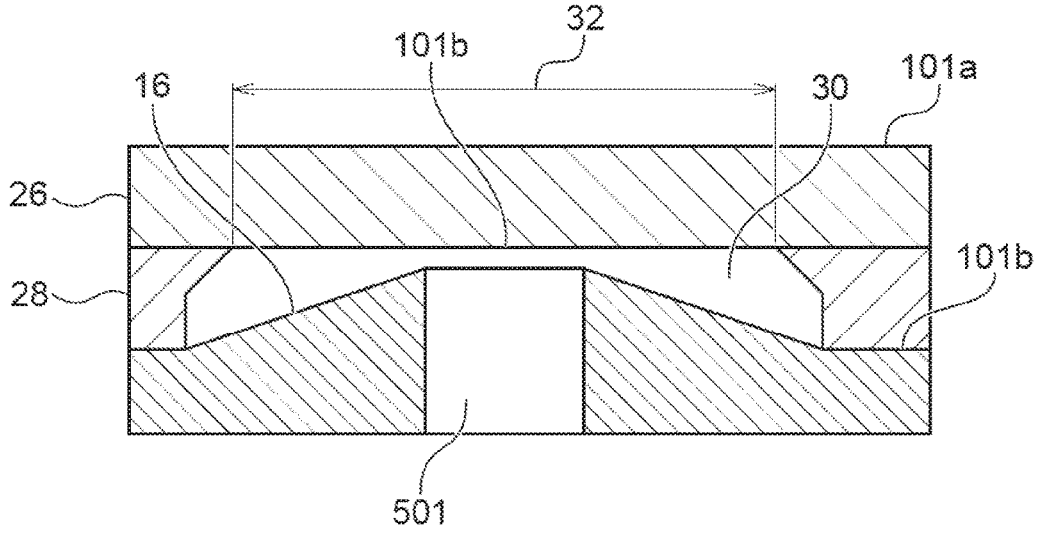
FIGS. 7A and 7B are views showing the concave portion 30 provided in the back surface 101*b* of the polishing pad 101.
Figure 7B:
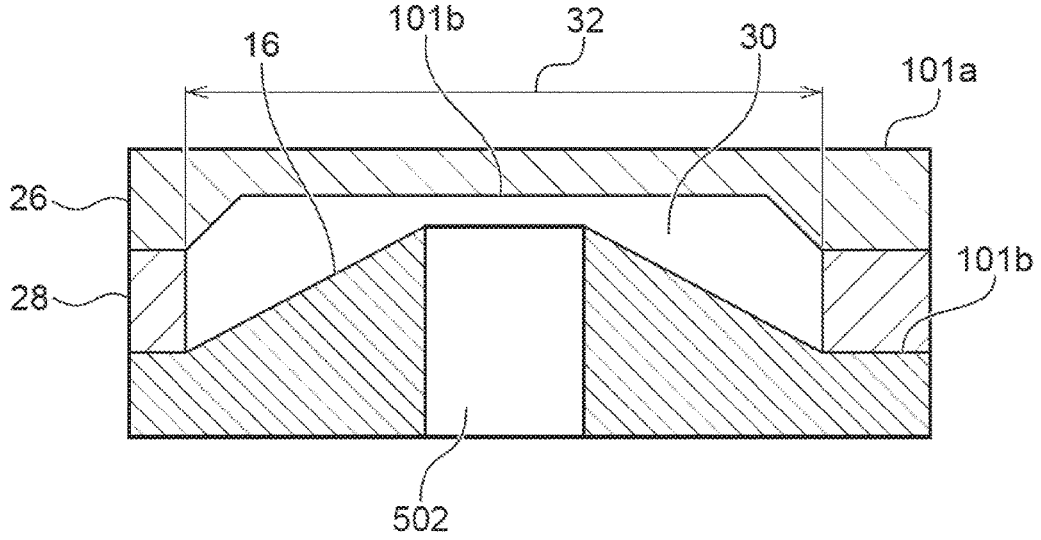

In FIG. 7A, a part of the backing layer 28 is completely removed, and the concave portion 30 is formed. In FIG. 7B, the part of the backing layer 28 is completely removed, and a part of the polishing layer 26 is made thin, whereby the concave portion 30 is formed. A region 32 is a portion from which the backing layer 28 has been completely removed. Meanwhile, in FIGS. 8A, 8B, 9A, and 9B, parts of the polishing layer 26 and the backing layer 28 are made thin without completely removing the backing layer 28, and thereby the concave portion 30 is formed.

Figure 8A:
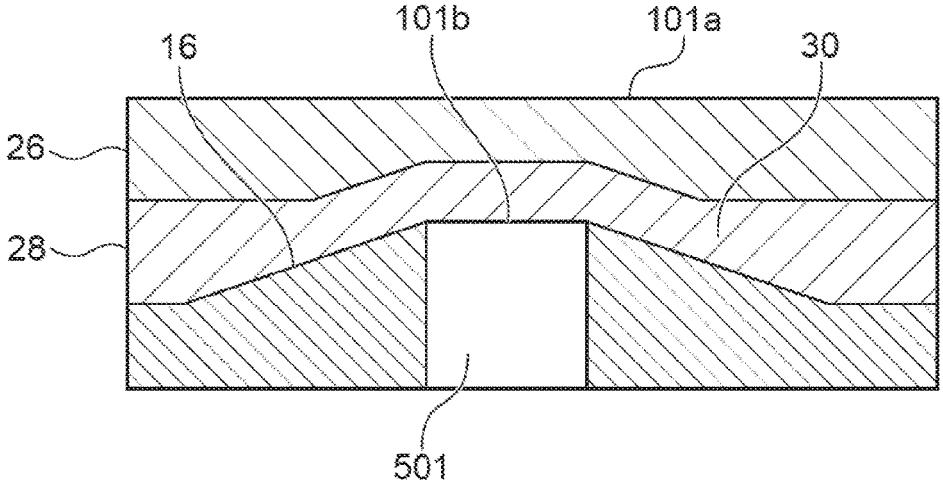
FIGS. 8A and 8B are views showing the concave portion 30 provided in the back surface 101*b* of the polishing pad 101.
Figure 8B:
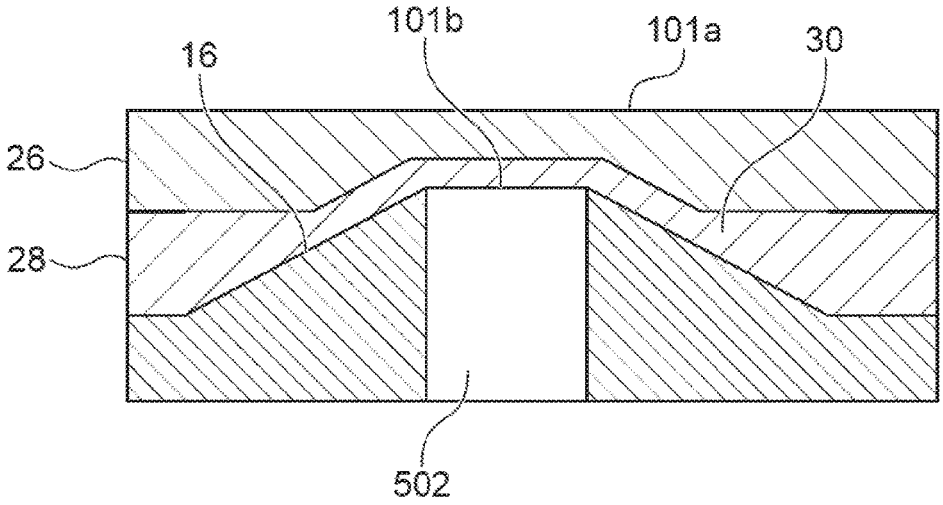
Figure 9A:
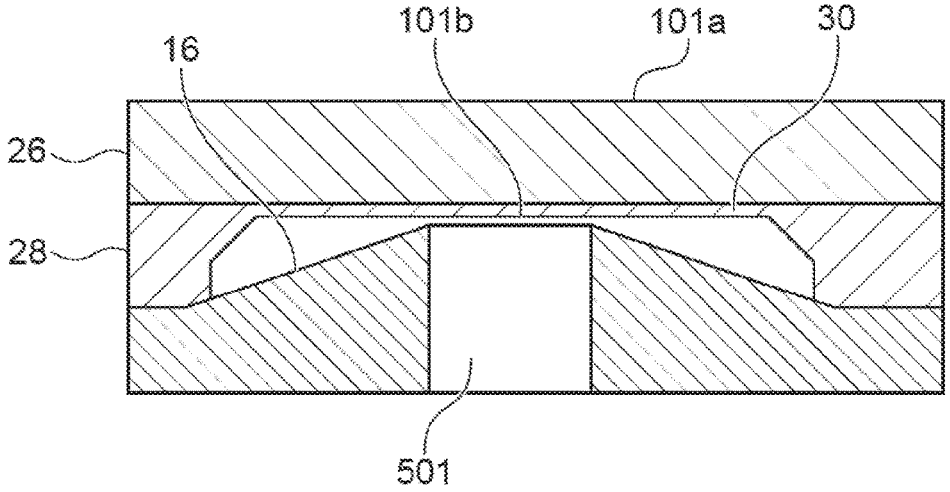
FIGS. 9A and 9B are views showing the concave portion 30 provided in the back surface 101*b* of the polishing pad 101.
Figure 9B:
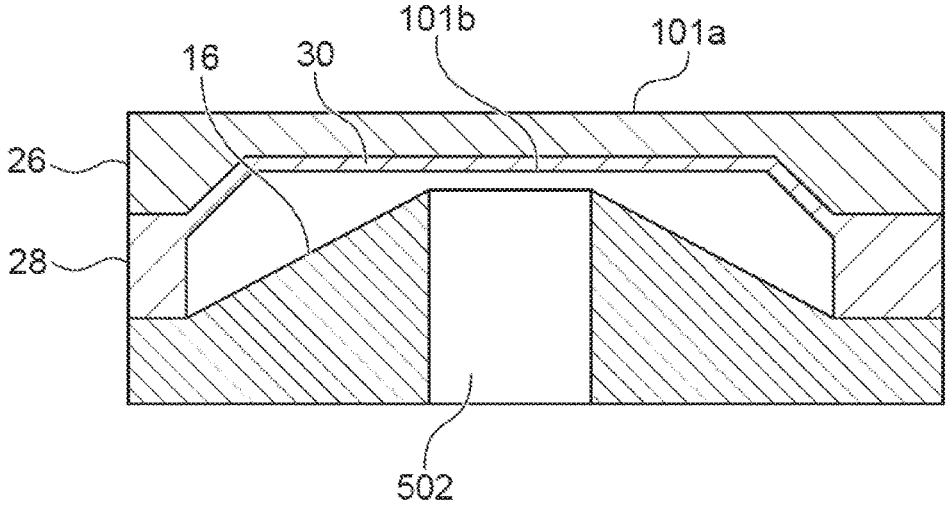

Unlike FIGS. 7A and 7B, in FIGS. 8A, 8B, 9A, and 9B, completely removing the backing layer 28 is not performed in the concave portion 30. In FIGS. 8A, 8B, and 9B, parts of the backing layer 28 and the polishing layer 26 are made thin, and the concave portion 30 is formed. In FIG. 9A, only a part of the backing layer 28 is made thin, and the concave portion 30 is formed.

Note that when FIGS. 6A and 6B to 9A and 9B are compared with each other, in FIGS. 6A, 6B, 8A, and 8B, the projection member 16 is in contact with the back surface 101*b* of the polishing pad 101. Meanwhile, in FIGS. 7A, 7B, 9A, and 9B, the projection member 16 is not in contact with the back surface 101*b* of the polishing pad 101. Note that in the specification in the present application, the back surface 101*b* of the polishing pad 101 means a lower surface of the backing layer 28 in a case where the backing layer 28 is present, and it means a lower surface of the polishing layer 26 in a case where the backing layer 28 is not present.

In a case where the projection member 16 and the back surface 101*b* of the polishing pad 101 come into contact with each other, when the wafer is pressed against the polishing layer 26 from above, the polishing layer 26 may become convex upwardly in a portion at which the projection member 16 is present, i.e. a portion in which the eddy current sensor 50 is present. Meanwhile, in a case where the projection member 16 and the back surface 101*b* of the polishing pad 101 are not in contact with each other, i.e. in a case where a space is present between the projection member 16 and the polishing pad 101, the polishing layer 26 may become concave downwardly. In the case where the polishing layer 26 becomes convex or concave, the shape affects polishing flatness of the wafer.

As measures against the above, in a case where the backing layer 28 is not completely removed, at least one shape of the backing layer 28 and the polishing layers 26 is appropriately processed and molded, or a material of at least one shape of the backing layer 28 and the polishing layers 26 is appropriately selected. Hereby, the above-described problem can be dealt with by designing the polishing apparatus so that the polishing layer 26 is deformed to the same extent in a portion with the projection member and a portion without it with respect to a pressure to the polishing layer 26 from an upper part.

In addition, in a case where the backing layer 28 is completely removed, the polishing layer 26 may be set to be deformed to the same extent in a portion with the projection member and a portion without it by forming another member in the removed portion. In forming another member, or without forming another member, the shape of the polishing layer 26 may be appropriately processed and molded, or the material of the polishing layer 26 may be appropriately selected.

Figure 10:
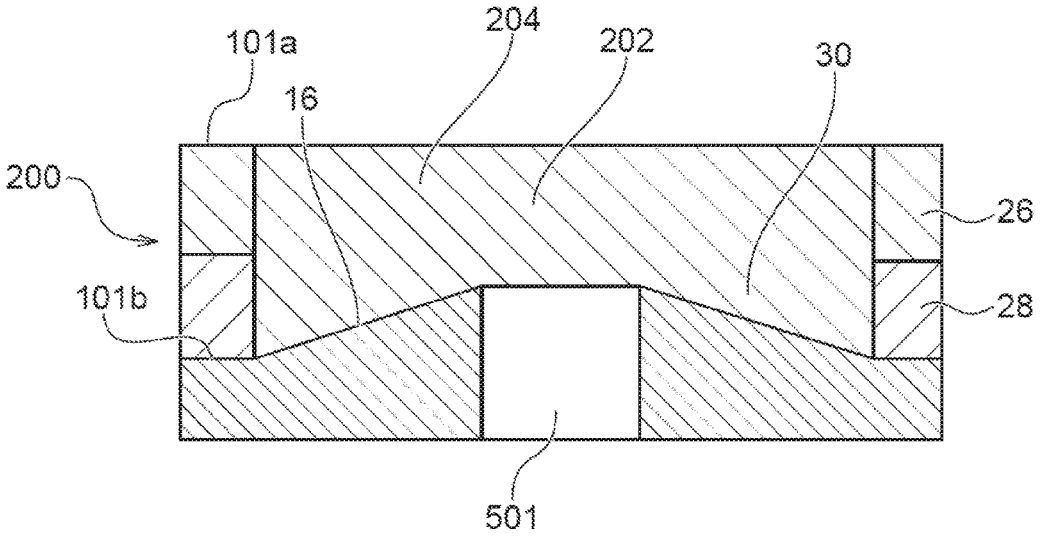
FIG. 10 is a view showing an example in which a polishing pad has a first member, and a second member separate and independent from the first member.

Next, there will be explained an Example in which the polishing pad 101 has a first member 200, and a second member 202 separate and independent from the first member 200, and in which a concave portion 30 is provided in the second member 202. FIG. 10 shows an example in which the first member 200 has the polishing layer 26 having the polishing surface 101*a*, and the backing layer 28 having the back surface 101*b*.

The first member 200 has a through hole 204 that penetrates the polishing surface 101*a* and the back surface 101*b* of the polishing pad 101. The second member 202 is arranged in the through hole 204. The second member 202 may just be a material having flexibility, such as a sponge-like material, and is not limited to a particular material. The second member 202 is, for example, a urethane sponge.

Figure 11:
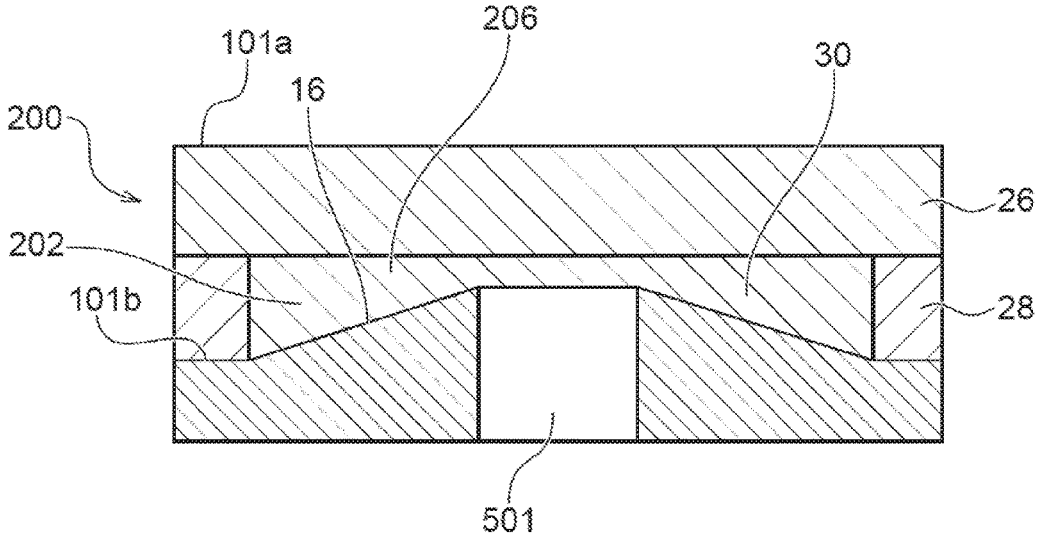
FIG. 11 is a view showing an Example of having a hole in a backing layer 28.

FIG. 11 is an Example of having a hole at least in the backing layer 28 out of the polishing layer 26 and the backing layer 28. Particularly, in FIG. 11, only the backing layer 28 has a hole 206, and the polishing layer 26 does not have a hole. The second member 202 is arranged in the hole 206. The second member 202 is, for example, a sponge-like material.

Figure 12:
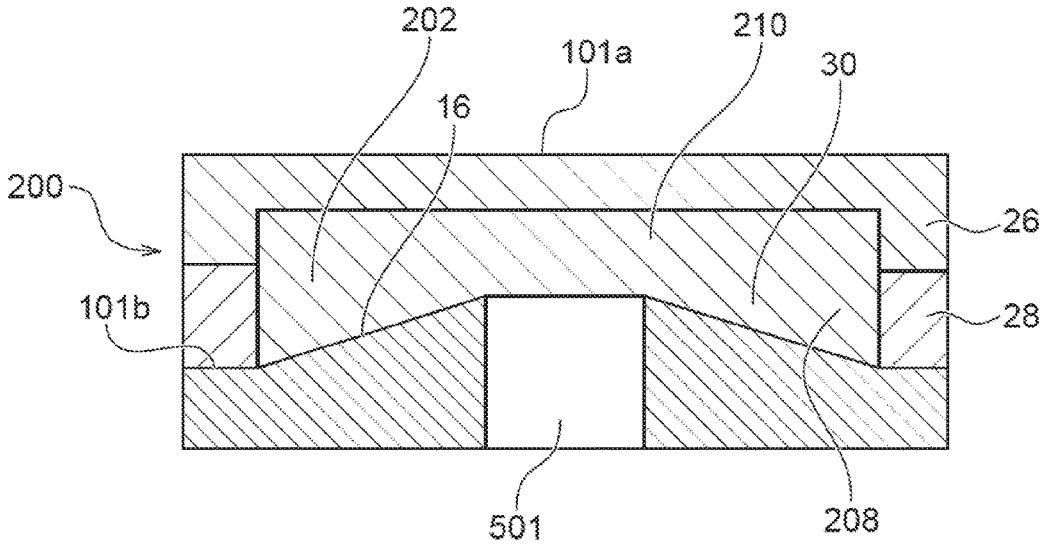
FIG. 12 is a view showing an Example of having a hole in both a polishing layer 26 and the backing layer 28.

FIG. 12 is an Example of having a hole in both the polishing layer 26 and the backing layer 28. In FIG. 12, the backing layer 28 has a through hole 208, and the polishing layer 26 has a hole 210 in a part thereof. The second member 202 is arranged in the through hole 208 and the hole 210. The second member 202 is, for example, a sponge-like material.

Figure 13:
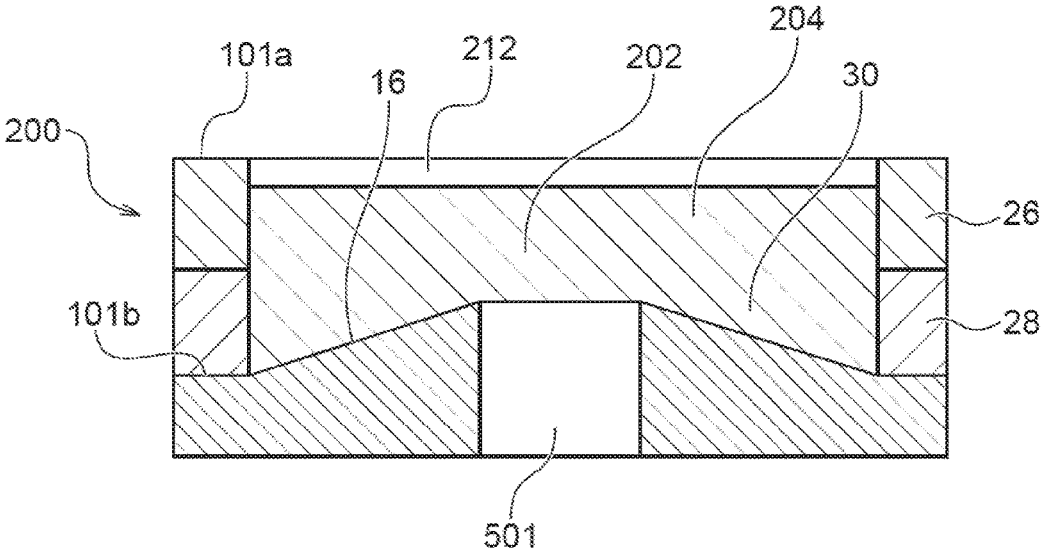
FIG. 13 is a view showing an example of having a third member 212 on a polishing surface 101*a* side of a second member 202.

In FIG. 13, the polishing pad 101 has a third member 212 on the polishing surface 101*a* side of the second member 202. The first member 200 has the through hole 204 that penetrates the polishing surface 101*a* and the back surface

101*b* of the polishing pad 101. The third member 212 having water resistance and chemical resistance is attached to an upper part of the second member 202 that is the sponge-like material. The third member 212 is a cover made of a sponge material, and a material of the third member 212 is not particularly limited if it is non-magnetic and non-conductive. The third member 212 is, for example, urethane resin.

Figure 14:
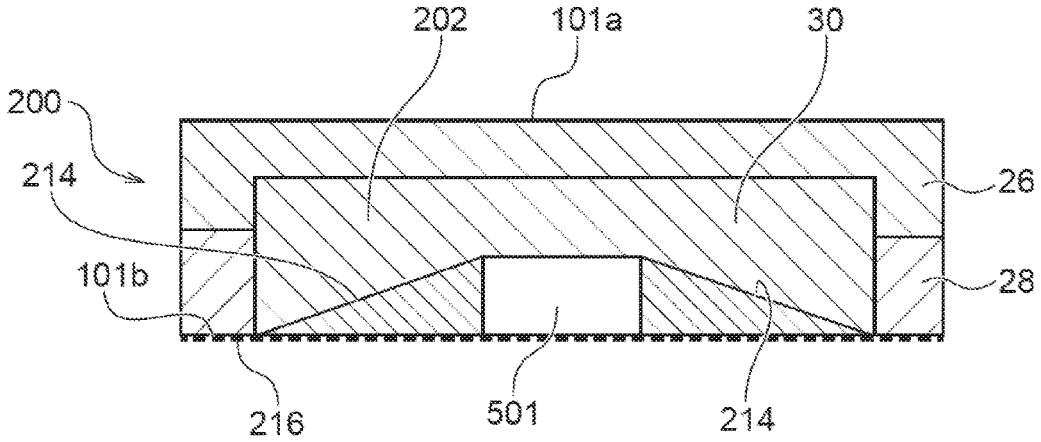
FIG. 14 is a view showing an example of providing an adhesive 214 in the second member 202.

In an Example of FIG. 14, an adhesive 216 for applying the polishing pad 101 to the polishing table 100 is provided at the backing layer 28 of the polishing pad 101. An adhesive 214 for applying the second member 202 to the projection member 16 may be provided also at the second member 202 that is the sponge-like material.

Although the first member 200 has the polishing layer 26 and the backing layer 28 in FIGS. 10 to 14, the first member 200 may have only the polishing layer 26 therein.

Figure 15:
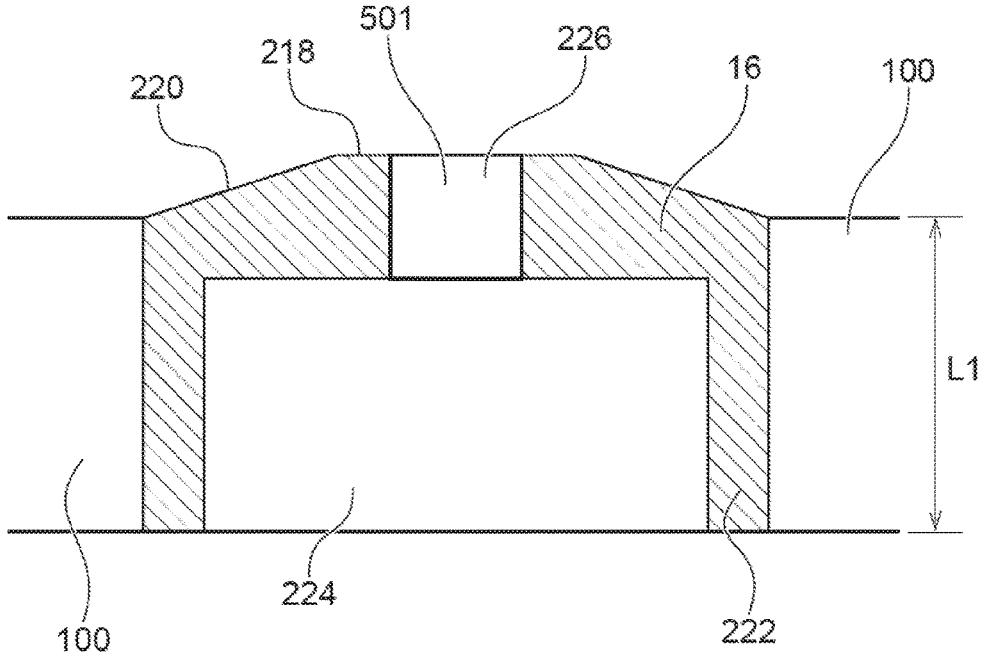
FIG. 15 is a view showing an example in which a projection member 16 includes a flat portion and an inclined portion that come into contact with the backing layer 28 of the polishing pad 101.

In an Example of FIG. 15, the projection member 16 includes a flat portion 218 and an inclined portion 220 that come into contact with the backing layer 28 or the second member 202 of the polishing pad 101. The flat portion 218 is provided at a top of the projection member 16. The inclined portion 220 is provided at side surfaces of the projection member 16. The projection member 16 is arranged in a through hole 222 provided in the polishing table 100. A height L1 of the polishing table 100 is the same as the height L1 of the projection member 16. The eddy current sensor 501 is arranged in internal spaces 224 and 226 provided inside the projection member 16.

In the Example of FIG. 15, since the projection member 16 and the polishing table 100 are members separate and independent from each other, only the projection member 16 can be solely manufactured to then be incorporated in the polishing table 100. The eddy current sensor 501 can be incorporated in the projection member 16 before the projection member 16 is incorporated in the polishing table 100. Since the projection member 16 and the polishing table 100 can be independently manufactured, manufacturing work and assembly work become easy as compared with a case where the projection member 16 and the polishing table 100 are integrally manufactured.

Since the projection member 16 and the polishing table 100 can be independently manufactured, the projection member 16 and the polishing table 100 can be made of different materials most suitable for each of them. The material of the projection member 16 is, for example, silicon carbide (SIC) and stainless steel (SUS). The material of the polishing table 100 is, for example, SIC and SUS.

As explained above, the present invention has the following modes.

According to a first mode of a polishing apparatus of the invention in the present application, there is provided a polishing apparatus including: a polishing table to which a back surface of a polishing pad is attached, wherein the polishing pad has a polishing surface for polishing a polishing target, and the back surface is on an opposite side of the polishing surface; a holding part that is opposed to the polishing surface of the polishing pad, and can hold the polishing target; and an end point detection sensor that is arranged in the polishing table, and detects an end point of the polishing, in which the polishing table has on an attachment surface a projection member projecting from the attachment surface to which the polishing pad is attached, and in which at least a part of the end point detection sensor is arranged inside the projection member.

According to the above mode, since the end point detection sensor is arranged inside the projection member projecting from the attachment surface to which the polishing pad is attached, and the back surface of the polishing pad has a concave portion in a portion opposed to the projection member, a distance between the polishing target and the sensor can be reduced. A film thickness of a smaller range than conventional can be measured with high sensitivity.

In addition, in the polishing pad with the different shape being firstly attached to the polishing table, or in the polishing pad being exchanged for a new one when a polishing pad with the same shape becomes worn, in a case where the end point detection sensor is exposed outside toward the polishing pad from the attachment surface of the polishing table without using the projection member of the embodiment in the polishing pad being exchanged for a new one, there is the following problem. Namely, it is necessary to adjust a height of the end point detection sensor from the attachment surface whenever the polishing pad is newly attached or is exchanged so that the exposed end point detection sensor does not come into contact with the polishing pad.

In the embodiment, since the end point detection sensor is arranged inside the projection member, the end point detection sensor does not come into contact with the polishing pad. Therefore, in the embodiment, in the polishing pad with the different shape being firstly attached to the polishing table, or in the polishing pad being exchanged for a new one with the same shape, it is unnecessary to adjust the height of the end point detection sensor from the attachment surface. Namely, before and after the polishing pad with the different shape is firstly attached to the polishing table, or before and after the polishing pad is exchanged for the new one, the height of the end point detection sensor from the attachment surface can be always maintained at the same position inside the projection member. Further, since the height of the end point detection sensor from the attachment surface is always located at the same position, there is an advantage that sensitivity of the end point detection sensor is stabilized.

Arbitrary shapes can be employed for the shape of the projection member, and shapes, such as a cylinder, a prism, a truncated cone, a truncated pyramid can be employed.

According to a second mode of the invention in the present application, the projection member is integrated with the polishing table. According to a third mode of the invention in the present application, the projection member is a component part independent from the polishing table. In a case where the projection member is the component part independent from the polishing table, the projection member can be easily detached from the polishing table. At this time, the projection member and the end point detection sensor are previously assembled, and subsequently, the assembly may be attached to the polishing table.

According to a fourth mode of the invention in the present application, the projection member is in contact with the back surface of the polishing pad. According to a fifth mode of the invention in the present application, the projection member is not in contact with the back surface of the polishing pad.

According to an sixth mode of the invention in the present application, the whole end point detection sensor is arranged inside the polishing table. Namely, as shown in the first mode of the invention in the present application, at least the part of the end point detection sensor is arranged inside the projection member, and the other portion of the end point detection sensor that is not arranged inside the projection member is arranged inside the polishing table other than the projection member.

According to a seventh mode of the invention in the present application, the end point detection sensor does not project to an outside of the polishing table from the projection member. According to the sixth and seventh modes of the invention in the present application, the end point detection sensor can be prevented from coming into contact with the outside of the polishing table. Particularly, the polishing pad around the projection member, and the end point detection sensor can be prevented from coming into contact with each other.

According to a eighth mode of the invention in the present application, a polishing pad is used in the polishing apparatus according to the first mode, wherein the back surface of the polishing pad has a concave portion in a portion opposed to the projection member.

According to a ninth mode of the invention in the present application, the polishing pad has a polishing layer having the polishing surface, and a backing layer having the back surface, and a thickness of at least one of the polishing layer and the backing layer in the concave portion is thinner than that of at least one of the polishing layer and the backing layer other than the concave portion. According to a tenth mode of the invention in the present application, the polishing pad has a polishing layer having the polishing surface, and a backing layer having the back surface, and in the concave portion, at least one of the polishing layer and the backing layer has a hollow on a polishing surface side.

In the ninth and tenth modes of the invention in the present application, a hollow of the back surface of the polishing pad may be formed by removing the part of the backing layer, or may be formed without removing it, and in a case of not removing it, an existing polishing pad including urethane foam etc. can be deformed with heat to thereby easily form a hollow.

According to an eleventh mode of the invention in the present application, the polishing pad has: a first member; and a second member separate and independent from the first member, and the concave portion is provided in the second member. According to the tenth mode of the invention in the present application, since the first member and the second member are separate and independent from each other, the concave portion is solely formed only in the second member, and the second member can be incorporated in the first member. Manufacturing work and assembly work become easy.

According to a twelfth mode of the invention in the present application, the first member has: a polishing layer having the polishing surface; and a backing layer having the back surface, at least the backing layer of the polishing layer and the backing layer has a hole, and the second member is arranged in the hole.

According to a thirteenth mode of the invention in the present application, the first member has a hole that penetrates the polishing surface and the back surface of the polishing pad, and the second member is arranged in the penetrating hole.

According to a fourteenth mode of the invention in the present application, the polishing pad has a third member on the polishing surface side of the second member.

Although the embodiments of the present invention have been described above based on some examples, the described embodiments are for the purpose of facilitating the understanding of the present invention and are not intended to limit the present invention. The present invention may be modified and improved without departing from the spirit thereof, and the invention includes equivalents thereof. In addition, the elements described in the claims and the specification can be arbitrarily combined or omitted within a range in which the above-mentioned problems are at least partially solved, or within a range in which at least a part of the advantages is achieved.

This application claims priority under the Paris Convention to Japanese Patent Application No. 2015-195823 filed on Oct. 1, 2015 and Japanese Patent Application No. 2016-157717 filed on Aug. 10, 2016. The entire disclosure of Japanese Patent Application Nos. 2015-195823 and 2016-157717 including specification, claims, drawings and abstract is incorporated herein by reference in its entirety. The entire disclosure of Japanese Patent Application No. 2012-135865 including specification, claims, drawings and abstract is incorporated herein by reference in its entirety.

REFERENCE SIGNS LIST

1 top ring
10 polishing apparatus
12, 14, and 16 projection member
26 polishing layer
28 backing layer
30 concave portion
50 eddy current sensor
100 polishing table
101 polishing pad

What is claimed is:

1. A polishing apparatus comprising:

a polishing table to which a back surface of a polishing pad is attached, wherein the polishing pad has a polishing surface for polishing a polishing target, and the back surface is on an opposite side of the polishing surface;

a holding part that is opposed to the polishing surface of the polishing pad, and can hold the polishing target; and an end point detection sensor that is arranged in the polishing table, and detects an end point of the polishing, wherein the polishing table has an attachment surface to which the polishing pad is attached, the polishing table has a projection member on the attachment surface, the projection member projects from the attachment surface, at least a part of the end point detection sensor is arranged inside the projection member, and the polishing table has an opening which is on an opposite side of the attachment surface, and/or the projection member has an opening which faces the polishing pad.

2. The polishing apparatus according to claim 1, wherein the projection member is integrated with the polishing table.

3. The polishing apparatus according to claim 1, wherein the projection member is a component part independent from the polishing table.

4. The polishing apparatus according to claim 1, wherein the projection member can be in contact with the back surface of the polishing pad.

5. The polishing apparatus according to claim 1, wherein the projection member does not contact with the back surface of the polishing pad.

6. The polishing apparatus according to claim 1, wherein the whole end point detection sensor is arranged inside the polishing table.

7. The polishing apparatus according to claim 1, wherein the end point detection sensor does not project to an outside of the polishing table from the projection member.

8. A polishing pad which is used in the polishing apparatus according to claim 1, wherein the back surface of the polishing pad has a concave portion in a portion opposed to the projection member.

9. The polishing pad according to claim 8, wherein the polishing pad has a polishing layer having the polishing surface, and a backing layer having the back surface, and a thickness of at least one of the polishing layer and the backing layer in the concave portion is thinner than that of the at least one of the polishing layer and the backing layer other than the concave portion.

10. The polishing pad according to claim 1, wherein the polishing pad has a polishing layer having the polishing surface, and a backing layer having the back surface, and at least one of the polishing layer and the backing layer has a concave portion in a portion opposed to the projection member.

11. The polishing pad according to claim 8, wherein the polishing pad has a first member having one part of the back surface, and a second member having other part of the back surface, the second member is separate and independent from the first member, and the concave portion is provided in the second member.

12. The polishing pad according to claim 11, wherein the first member has a polishing layer having the polishing surface and a backing layer having the part of the back surface, the backing layer has a hole, and the second member is fitted in the hole.

13. The polishing pad according to claim 11, wherein the first member has a hole that penetrates from the polishing surface side to the back surface side, and the second member is fitted in the penetrating hole.

14. The polishing pad according to claim 13, wherein the polishing pad has a third member which is fitted in the penetrating hole and is located on the polishing surface side of the second member.

* * * * *